US008833084B2

(12) United States Patent
Carlisle

(10) Patent No.: US 8,833,084 B2
(45) Date of Patent: Sep. 16, 2014

(54) COMBUSTOR TILE MOUNTING ARRANGEMENT

(75) Inventor: Michael Lawrence Carlisle, Derby (GB)

(73) Assignee: Rolls-Royce PLC (GB)

( * ) Notice: Subject to any disclaimer, the term of this patent is extended or adjusted under 35 U.S.C. 154(b) by 1064 days.

(21) Appl. No.: 12/839,694

(22) Filed: Jul. 20, 2010

(65) Prior Publication Data

US 2011/0030378 A1 Feb. 10, 2011

(30) Foreign Application Priority Data

Aug. 5, 2009 (GB) ..... 0913580.7

(51) Int. Cl.
*F23R 3/00* (2006.01)
*F23R 3/60* (2006.01)

(52) U.S. Cl.
CPC ..... *F23R 3/007* (2013.01); *F23R 2900/03041* (2013.01); *F23R 3/002* (2013.01); *F23R 2900/03042* (2013.01); *F23R 3/60* (2013.01)
USPC ..... 60/753; 60/752; 60/796; 60/800

(58) Field of Classification Search
CPC ..... F23R 3/007; F23R 3/002; F23R 3/60; F23R 2900/03041; F23R 2900/03042
USPC ..... 60/752–760, 796, 800
See application file for complete search history.

(56) References Cited

U.S. PATENT DOCUMENTS

| | | | | | |
|---|---|---|---|---|---|
| 2,135,118 | A | * | 11/1938 | Stewart | 52/396.1 |
| 2,919,549 | A | * | 1/1960 | Haworth et al. | 60/753 |
| 3,918,255 | A | * | 11/1975 | Holden | 60/753 |
| 3,950,908 | A | * | 4/1976 | Van Eyk | 52/436 |
| 4,085,580 | A | * | 4/1978 | Slattery | 60/756 |
| 4,422,300 | A | * | 12/1983 | Dierberger et al. | 60/757 |
| 4,749,029 | A | * | 6/1988 | Becker et al. | 165/47 |
| 5,363,643 | A | * | 11/1994 | Halila | 60/796 |
| 5,704,208 | A | * | 1/1998 | Brewer et al. | 60/766 |
| 6,223,538 | B1 | * | 5/2001 | Benz et al. | 60/753 |
| 6,341,485 | B1 | * | 1/2002 | Liebe | 60/772 |
| 6,675,586 | B2 | * | 1/2004 | Maghon | 60/796 |
| 6,708,499 | B2 | * | 3/2004 | Pidcock et al. | 60/796 |
| 6,857,275 | B2 | * | 2/2005 | Pidcock et al. | 60/796 |
| 6,895,761 | B2 | * | 5/2005 | Mitchell et al. | 60/796 |
| 7,140,185 | B2 | * | 11/2006 | Burd | 60/752 |

FOREIGN PATENT DOCUMENTS

EP 1741981 A1 10/2007

* cited by examiner

*Primary Examiner* — Willam H Rodriguez
*Assistant Examiner* — Carlos A Rivera
(74) *Attorney, Agent, or Firm* — McCormick Paulding & Huber LLP

(57) ABSTRACT

A tile is provided for lining the hot side of a wall of a combustor. The tile has a tile body with one or more bosses protruding from the cold side thereof. The or each boss extends, in use, through the wall of the combustor and has a threaded recess formed therein for threadingly connecting with a bolt which is inserted into the recess from the cold side of the combustor wall. The bolt fastens the tile to the combustor wall.

17 Claims, 3 Drawing Sheets

COMBUSTOR TILE MOUNTING ARRANGEMENT

CROSS REFERENCE TO RELATED APPLICATION

This application is entitled to the benefit of British Patent Application No. GB 0913580.7, filed on Aug. 5, 2010.

FIELD OF THE INVENTION

The present invention relates to a tile for lining the hot side of a wall of a combustor.

BACKGROUND OF THE INVENTION

The temperature of the gases released by the combustion process in a gas turbine engine may peak above 2100° C. and average 1500° C. This is much higher than the melting point of combustion chamber materials. Thus many gas turbine engine combustors employ ceramic or ceramic-coated tiles to line the combustor wall.

The individual tiles are attached to the combustor wall (e.g. the annular "cold skin" which forms the sides of the combustor) and cooling air passes through holes in the wall to impinge on the cold side of the tiles. The air then moves through a series of pedestals projecting from the cold side of the tiles to improve the convective heat transfer coefficient.

FIG. 1 shows a cut-away section through a combustor and illustrates a conventional fastening arrangement for a lining tile. The tile 1 has a threaded fixing stud 3, which extends from the cold side of the tile body 5 and passes through a hole 7 in the combustor wall 9. A washer 11 is placed over the stud and a nut 13 screws onto the stud to pull the tile towards the combustor wall, pedestals 15 on the cold side of the tile body determining the final spacing between the tile body and the wall.

Alternative tile fixing arrangements are proposed in U.S. Pat. No. 4,085,580 and U.S. Pat. No. 5,079,915.

To produce higher engine efficiencies and reduce emissions, there is a tendency for engine cycles to increase in temperature. The higher combustor temperatures, which this requires can require different cooling arrangements. In particular, pedestal cooling may be superseded by impingement effusion tile cooling arrangements. In such arrangements, the tile body has an array of effusion cooling through-holes, at a low angle (e.g. about 20°) to the surface. Cooling air effusing from the holes forms a protective cooling layer on the hot side of the tiles.

The cooling air effusion holes may be formed by laser machining of the tile body. However, this presents a problem in that laser machining is a line of sight process. As illustrated in the diagram of FIG. 2, which is a schematic cross-section through a tile, the fixing stud 3 obstructs laser drilling of effusion holes 17 in an area of the tile body 5 around the stud because of interference of the stud with the laser tool and/or the path (dashed, single headed arrow lines) of the laser beam. Thus the result can be a significant area (the extent of which is indicated by the double headed arrow line) around each stud that is devoid of cooling holes. Alternatively, approach vectors may have to be defined for the laser that avoid interference with the studs to produce holes in the vicinity of the studs. This requires extra programming and extra machining time, and may produce sub-optimal X, Y positions of the holes on the surface of the tile and/or sub-optimal angles of the holes to the surface.

SUMMARY OF THE INVENTION

Accordingly, a first aspect of the present invention provides a tile for lining a wall of a combustor the wall having a hot side intended to face a combustion volume and a corresponding cold side intended to face away from the combustion volume, the tile having a tile body with one or more bosses protruding from a cold side thereof, the one or more bosses extending, in use, through the wall of the combustor, wherein the boss has a threaded recess formed therein for threadingly connecting with a bolt which is inserted into the recess from the cold side of the combustor wall, whereby the bolt fastens the tile to the combustor wall.

Such a boss can have a significantly reduced height relative to a conventional fixing stud, and thus, in a tile with laser machined effusion holes, the area around the boss which can be problematic to machine may be much reduced. Although the boss is therefore particularly advantageous when used in relation to a tile with laser machined effusion holes, it may also be used on tiles with other types of cooling features, such as cooling pedestals.

The tile may have any one or any combination of the following optional features.

Typically, the tile body has a generally rectangular or square shape, although it may be curved to e.g. fit to an annular combustor wall. There may be a boss at each corner of such a tile.

Typically, the combustor is a combustor of a gas turbine engine.

Typically, a plurality of cooling air effusion holes, e.g. angled at 20° or less to the hot side surface of the tile body, traverse the tile body.

Preferably, the tile body has one or more spacing projections (such as one or more rails extending along the perimeter of the tile body) protruding from the cold side thereof, the spacing projections engaging with the hot side of the combustor wall when the tile is fastened thereto to determine a spacing of the tile body from the combustor wall. Such spacing projections, being discrete from the one or more bosses, avoid the need for the boss to set the spacing of the tile body from the combustor wall. Cooling air can flow into the gap between the tile body and the combustor wall and thence to e.g. the effusion holes.

The boss can be made as long as is necessary to accommodate in the recess a desired number of thread turns. However, as an alternative to increasing the height of the boss to accommodate more thread turns, optionally the recess may be extended into the tile body.

The one or more bosses may have a respective spacer which, in use, interposes between a head of the bolt and the boss, the spacer engaging at one side with the head of the bolt and at the opposite side with the cold side of the combustor wall. The spacer can thus determine a spacing between the head of the bolt and the cold side of the combustor wall.

The spacer may contain one or more cooling air passages through which cooling air is sent to the hot side of the combustor wall e.g. to a gap between the tile body and the combustor wall.

Optionally, one or more channels may extend through the or each boss to carry cooling air to the foot of the recess. Typically, the one or more channels fluidly connects to one or more effusion holes extending from the foot of the recess to the hot side of the tile body. In this way, cooling air may be introduced to the region of the tile body, which in a tile with a conventional fixing stud is difficult to provide with effusion holes.

Conveniently, the cooling air carried by the one or more channels through the boss is received from cooling air passage(s) of the spacer.

A second aspect of the present invention provides a combustor having one or more walls lined with tiles according to the previous aspect (the tile optionally having any one or any combination of the referred to above). For example, the lined wall(s) can be an annular side wall of the combustor, and/or a heat shield front wall of the combustor.

Where the terms "hot side" and "cold side" and "hot surface" and "cold surface" are used these relate both to their intended and actual use. Accordingly, where the combustor or tile is not in use it is entirely feasible for the hot and cold sides or surfaces to be at the same ambient temperature. However, when the combustor or tile is in use the hot surface will be the surface facing towards the combustion volume and the cold surface will be an opposing surface facing away from the combustion volume.

DETAILED DESCRIPTION OF THE PREFERRED EMBODIMENTS

Figure 3:
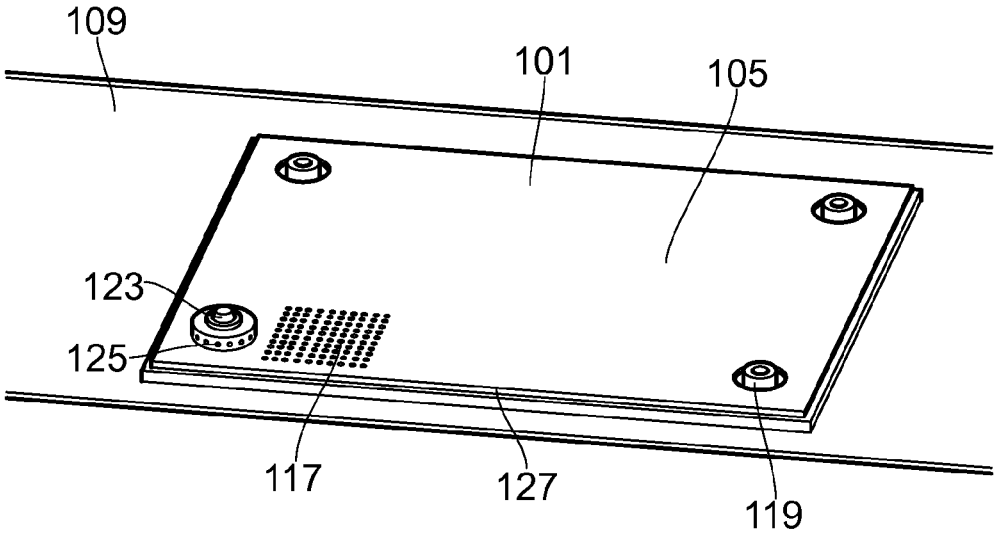
FIG. 3 shows a schematic perspective view of a tile according to a first embodiment of the present invention and the corresponding portion of combustor wall to which the tile is fixed.
Figure 4:
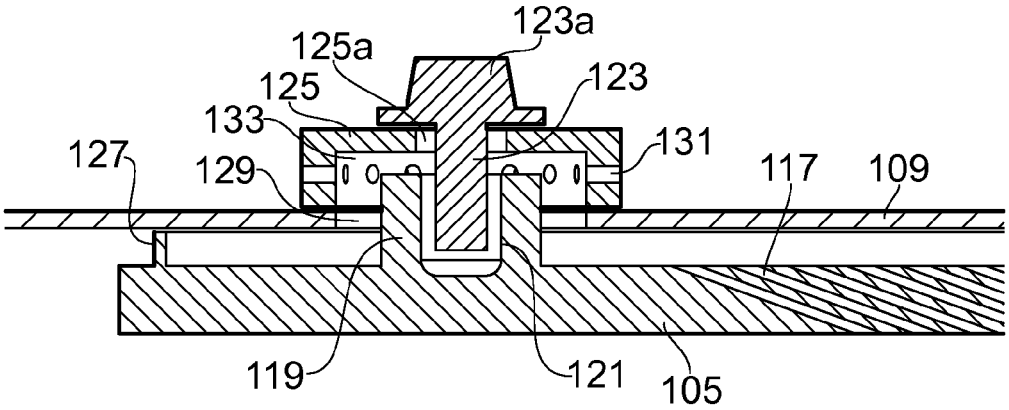
FIG. 4 shows a schematic cross-section through one of the fixing arrangements which are provided at the corner regions of the rectangular tile body of the tile of FIG. 3.

FIG. 3 shows a schematic perspective view of a tile 101 according to a first embodiment of the present invention and the corresponding portion of a combustor wall 109 (i.e. cold skin) to which the tile is fixed. For clarity, the combustor wall is made transparent. Further, the tile and portion of combustor wall are as flat objects, although in reality they would curve around the annulus of the wall. The tile has a rectangular tile body 105, and FIG. 4 shows a schematic cross-section through one of the fixing arrangements, which are provided at the corner regions of the body. An array of cooling air effusion holes 117 traverses the tile body, but in FIGS. 3 and 4 only a small number of these holes are shown.

Each fixing arrangement comprises a boss 119 protruding from the cold side of the tile body 105 to extend through a hole 129 in the combustor wall 109. The boss has a threaded recess 121 into which is screwed a bolt 123 from the cold side of the combustor wall. A ring-shaped spacer 125 encircles the boss where it projects from the cold side of the combustor wall. The bolt passes through the central hole 125*a* in the spacer with the head 123*a* of the bolt pushing down on the top of the spacer to urge it against the combustor wall and thereby determine the spacing between the head 123*a* of the bolt and the wall. The head of the bolt and the spacer, which may have a curved surface to match the curved combustor wall, seal respectively the central hole in the spacer and the hole in the combustor wall. A rail 127 extends around the perimeter of the cold side of the tile body and is pulled by the bolt against the hot side of the combustor wall to determine the spacing between the tile body from the combustor wall. Together, the spacer and the rail determine the extent to which the bolt penetrates into the recess. In FIG. 3 the bolt and fixing spacer of only one of the fixing arrangements are shown.

Figure 1:
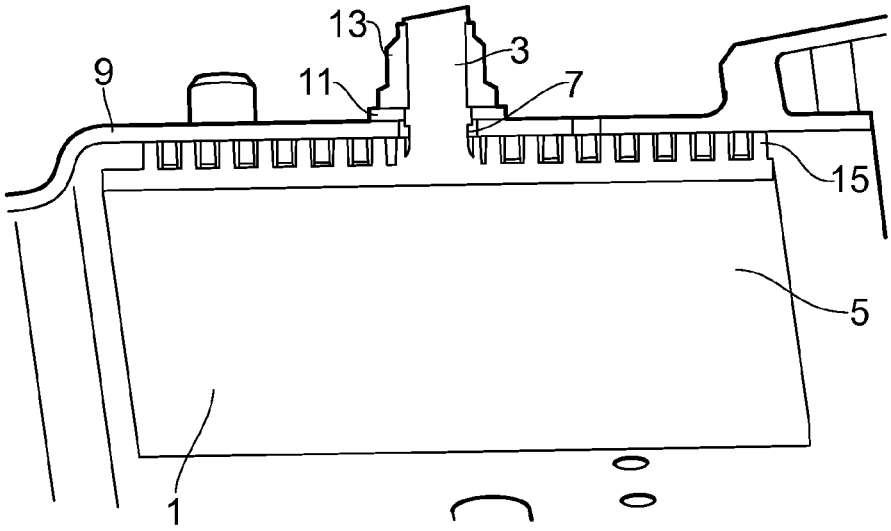
FIG. 1 Prior Art
FIG. 1 shows a cut-away section through a combustor, illustrating a conventional fastening arrangement for a lining tile.
Figure 2:
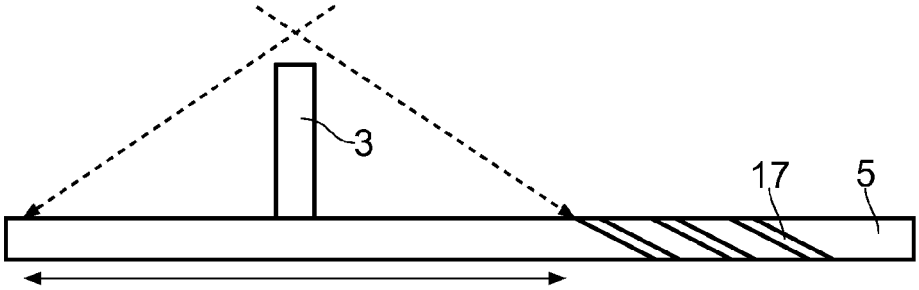
FIG. 2 Prior Art
FIG. 2 shows a schematic cross-section through a tile having a conventional fixing stud.

Advantageously, because the distance marked with the doubled headed arrowed line in FIG. 4 can be used to threadingly connect the bolt 123 to the boss 119, the distance by which the boss projects from the cold side of the combustor wall 109 is significantly reduced relative to the equivalent projection distance of the fixing stud 3 of the conventional tile 5, shown in FIGS. 1 and 2, in which all mating threads are situated outside the combustor wall 9. This facilitates laser machining of the effusion holes 117 of the tile 105 of the first embodiment at a close proximity to the boss, reducing the area around the boss which is devoid of effusion holes or for which different laser tool approach vectors have to be programmed, and ultimately improving the cooling performance of the tile.

The projection distance of the boss can be further reduced if the recess 121 extends into the tile body 105, allowing the mating threads to be lowered in the recess.

The spacer 125 has a plurality of radially extending passages 131, which carry cooling air from the cold side of the combustor wall 109 to a central cavity 133 formed in the spacer. From here, the cooling air passes through the hole 129 in the combustor wall 109, into the gap maintained between the combustor wall and the tile body 105, and then out through the effusion holes 117 to provide a protective cooling layer on the hot side of the tile body.

Figure 5:
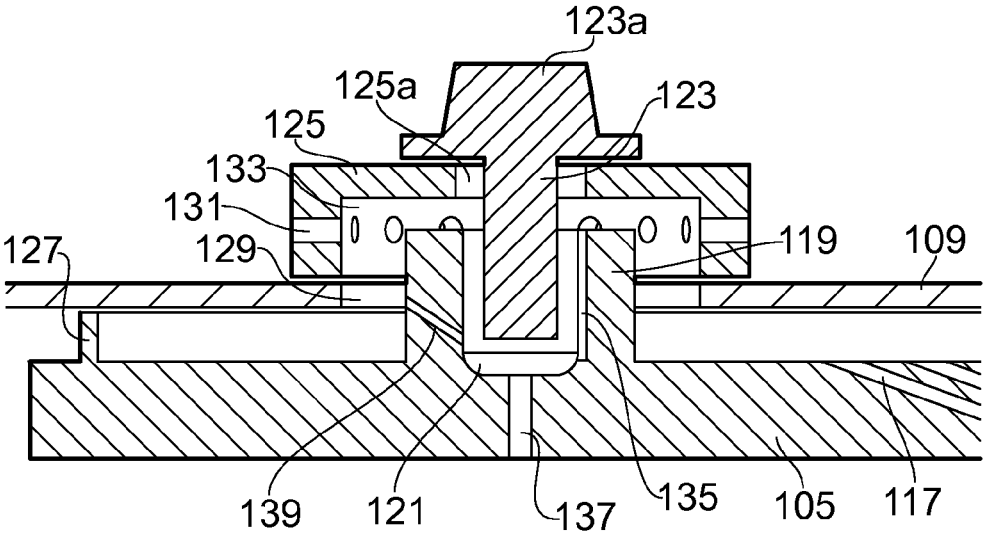
FIG. 5 shows a schematic cross-section through a fixing arrangement of a tile according to a second embodiment of the present invention.

FIG. 5 shows a schematic cross-section through a fixing arrangement of a tile according to a second embodiment of the present invention. Features of the tile of the second embodiment, which are the same as features of the tile of the first embodiment shown in FIGS. 3 and 4 share the same reference numbers.

The tile 105 of the second embodiment has enhancements to improve the cooling of the tile in the vicinity of the boss 119. More specifically, one or more channels 135 run along the side of the recess 121. Cooling air conveyed by the radially extending passages 131 in the spacer 125 is thus carried, via the central cavity 133 of the spacer, to the channel or channels 135 and thence to the foot of the recess. From here, an effusion hole 137 extends across the tile body bringing cooling air to a position directly underneath the boss 119. In an alternative version of the tile, instead of having a channel or channels 135 running along the side of the recess 121, the tile may have one or more channels 139 extending between the recess and the radially outer surface of the boss, e.g. to exit in the hole 129 of the combustor wall 109 (as shown in FIG. 5) or in the central cavity of the spacer.

The channel or channels 135 running along the side of the recess 121 could be formed during casting of the tile 101. The channel or channels 139 extending between the recess 121 and the radially outer surface of the boss 119 could be formed by post-casting machining.

Although the tiles 101 of the first and second embodiments have been described in respect of an annular combustor cold skin, the invention could also be applied to tiles lining the heat shield (front wall) of a combustor.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting.

What is claimed is:

1. A tile arrangement for lining an outer wall of a combustor, the outer wall having a hot side intended to face a combustion volume and a corresponding cold side intended to face away from the combustion volume, the tile arrangement comprising:

a tile body having one or more integral bosses protruding from a cold side of said tile body, the one or more integral bosses extending through the outer wall of the combustor, wherein each of the one or more integral bosses has a threaded recess formed therein that threadingly connects with a bolt inserted into the threaded recess from the cold side of the outer wall, whereby the bolt fastens the tile to the combustor wall, and has a respective spacer interposed between a head of the bolt and the boss, the spacer engaging at one side with the head of the bolt and at the opposite side with the cold side of the combustor wall, wherein the tile body has one or more spacing projections protruding from the cold side thereof, the spacing projections engaging with the hot side of the combustor wall when the tile is fastened thereto to determine a spacing of the tile body from the combustor wall.

2. A tile arrangement according to claim 1, wherein the recess extends into the tile body.

3. A tile arrangement according to claim 1, wherein a plurality of cooling air effusion holes traverse the tile body.

4. A tile arrangement according to claim 1, wherein the spacer contains one or more cooling air passages through which cooling air is sent to the hot side of the combustor wall.

5. A tile for lining a wall of a combustor, the wall having a hot side intended to face a combustion volume and a corresponding cold side intended to face away from the combustion volume, the tile comprising:

a tile body having one or more bosses protruding from a cold side of said tile body, each of the one or more bosses extendingthrough the wall of the combustor, having a threaded recess formed therein for threadingly connecting with a bolt when inserted into the threaded recess from the cold side of the combustor wall, whereby the bolt fastens the tile to the combustor wall, and having a respective spacer which interposes between a head of the bolt and the boss, the spacer engaging at one side with the head of the bolt and at the opposite side with the cold side of the combustor wall, wherein the tile body has one or more spacing projections protruding from the cold side thereof, the spacing projections engaging with the hot side of the combustor wall when the tile is fastened thereto to determine a spacing of the tile body from the combustor wall.

6. A tile according to claim 5, wherein a plurality of cooling air effusion holes traverse the tile body.

7. A tile according to claim 5, wherein the spacer contains one or more cooling air passages through which cooling air is sent to the hot side of the combustor wall.

8. A tile according to claim 5, wherein the recess has a foot and one or more channels extend through the one or more bosses to carry cooling air to the foot of the recess.

9. A tile according to claim 8, wherein the one or more channels fluidly connects to one or more effusion holes extending from the foot of the recess to the hot side of the tile body.

10. A tile arrangement for lining an outer wall of a combustor, the outer wall having a hot side intended to face a combustion volume and a corresponding cold side intended to face away from the combustion volume, the tile arrangement comprising:

a tile body having one or more integral bosses protruding from a cold side of said tile body, the one or more integral bosses extending through the outer wall of the combustor, wherein each of the one or more integral bosses has a threaded recess formed therein that threadingly connects with a bolt inserted into the threaded recess from the cold side of the outer wall, whereby the bolt fastens the tile to the combustor wall, and has a respective spacer interposed between a head of the bolt and the boss, the spacer engaging at one side with the head of the bolt and at the opposite side with the cold side of the combustor wall, wherein the recess has a foot and one or more channels extend through the one or more bosses to carry cooling air to the foot of the recess.

11. A tile arrangement according to claim 10, wherein the one or more channels fluidly connects to one or more effusion holes extending from the foot of the recess to the hot side of the tile body.

12. A tile according to claim 10, wherein the recess extends into the tile body.

13. A tile according to claim 10, wherein the tile body has one or more spacing projections protruding from the cold side thereof, the spacing projections engaging with the hot side of the combustor wall when the tile is fastened thereto to determine a spacing of the tile body from the combustor wall.

14. A combustor having a wall having a hot side intended to face a combustion volume and a corresponding cold side intended to face away from the combustion volume, the intended hot side wall being lined with at least one tile, the tile having a tile body with one or more bosses protruding from a surface facing the hot side of the wall, the one or more bosses extending through the wall of the combustor, wherein each of the one or more bosses has a threaded recess formed therein for threadingly connecting with a bolt which is inserted into the recess from the cold side of the combustor wall, whereby the bolt fastens the tile to the combustor wall, and has a respective spacer which interposes between a head of the bolt and the boss, the spacer engaging at one side with the head of the bolt and at the opposite side with the cold side of the combustor wall, wherein the tile body has one or more spacing projections protruding from the surface facing the hot side of the wall, the spacing projections engaging with the hot side of the combustor wall when the tile is fastened thereto to determine a spacing of the tile body from the combustor wall.

15. A combustor according to claim 14, wherein the spacer contains one or more cooling air passages through which cooling air is sent to the hot side of the combustor wall.

16. A combustor according to claim 14, wherein the recess has a foot and one or more channels extend through the one or more bosses to carry cooling air to the foot of the recess.

17. A combustor according to claim 16, wherein the one or more channels fluidly connects to one or more effusion holes extending from the foot of the recess to the hot side of the tile body.

* * * * *

UNITED STATES PATENT AND TRADEMARK OFFICE

CERTIFICATE OF CORRECTION

PATENT NO. : 8,833,084 B2
APPLICATION NO. : 12/839694
DATED : September 16, 2014
INVENTOR(S) : Carlisle It is certified that error appears in the above-identified patent and that said Letters Patent is hereby corrected as shown below:

In the Specification

Column 1, line 8, delete "August 5, 2010" and insert --August 5, 2009--.

In the Claims

Column 5, line 37, Claim 5, delete "extendingthrough" and insert --extending through--.

Signed and Sealed this
Second Day of December, 2014

Michelle K. Lee

Michelle K. Lee
*Deputy Director of the United States Patent and Trademark Office*